US007837415B2

(12) United States Patent
Allington et al.

(10) Patent No.: US 7,837,415 B2
(45) Date of Patent: Nov. 23, 2010

(54) RETAINING WALL AND BLOCKS FOR THE FORMATION THEREOF

(75) Inventors: Chris James Allington, Canterbury (NZ); Dallas Rex James, Auckland (NZ); Timmothy John Day, Rolleston (NZ); Nigel Gary Maxey, Christchurch (NZ)

(73) Assignee: Holmes Solutions Limited (NZ)

( * ) Notice: Subject to any disclaimer, the term of this patent is extended or adjusted under 35 U.S.C. 154(b) by 0 days.

(21) Appl. No.: 12/295,296

(22) PCT Filed: Mar. 29, 2007

(86) PCT No.: PCT/NZ2007/000065

§ 371 (c)(1),
(2), (4) Date: Sep. 30, 2008

(87) PCT Pub. No.: WO2007/114713

PCT Pub. Date: Oct. 11, 2007

(65) Prior Publication Data

US 2009/0103988 A1 Apr. 23, 2009

(30) Foreign Application Priority Data

Mar. 31, 2006 (NZ) ..... 544434

(51) Int. Cl.
*E02D 29/02* (2006.01)

(52) U.S. Cl. ..... 405/286; 405/284; 405/262; 52/606

(58) Field of Classification Search ..... 52/606; 405/262, 284, 286
See application file for complete search history.

(56) References Cited

U.S. PATENT DOCUMENTS

| | | | | |
|---|---|---|---|---|
| 4,920,712 | A | 5/1990 | Dean | |
| 5,074,088 | A * | 12/1991 | Bergeron et al. | 52/309.12 |
| 5,214,898 | A * | 6/1993 | Beretta | 52/606 |
| 5,595,460 | A * | 1/1997 | Miller et al. | 405/286 |
| 5,601,384 | A | 2/1997 | Dawson | |

(Continued)

FOREIGN PATENT DOCUMENTS

| | | |
|---|---|---|
| NZ | 257237 | 5/1997 |

(Continued)

*Primary Examiner*—Frederick L Lagman
(74) *Attorney, Agent, or Firm*—Galbreath Law Offices, P.C.; John A. Galbreath

(57) ABSTRACT

A block having at least one front face, at least one back face, sides connecting the front and back faces, a top surface, a bottom surface and at least one cavity passing through the entire height of the block from the top surface to the bottom surface, wherein the cavity is positioned so that the centre of mass of the block lies closer to the back face than does the geometric centre of the block.

18 Claims, 7 Drawing Sheets

U.S. PATENT DOCUMENTS

| | | | | | |
|---|---|---|---|---|---|
| 5,673,530 | A | * | 10/1997 | Bailey, II | 52/606 |
| 5,711,130 | A | * | 1/1998 | Shatley | 405/286 |
| 5,848,511 | A | * | 12/1998 | Scales | 405/286 |
| 5,913,790 | A | * | 6/1999 | Dawson | 405/286 |
| 6,019,550 | A | * | 2/2000 | Wrigley et al. | 405/286 |
| 6,113,317 | A | * | 9/2000 | Myers | 405/284 |
| 6,287,054 | B1 | * | 9/2001 | Egan et al. | 405/286 |
| 6,523,317 | B1 | * | 2/2003 | Bott et al. | 52/609 |
| 6,622,445 | B1 | * | 9/2003 | Shillingburg et al. | 52/606 |
| 6,641,334 | B2 | * | 11/2003 | Woolford | 405/284 |
| 6,695,544 | B2 | | 2/2004 | Knudson | |
| 6,701,687 | B1 | * | 3/2004 | Shillingburg | 52/606 |
| 6,715,965 | B2 | * | 4/2004 | Manthei et al. | 405/284 |
| 6,792,731 | B2 | * | 9/2004 | Bott et al. | 52/603 |
| 6,912,823 | B2 | * | 7/2005 | MacDonald et al. | 405/284 |
| 7,503,730 | B2 | * | 3/2009 | Price | 405/286 |
| 2002/0001509 | A1 | * | 1/2002 | Hong | 405/286 |
| 2002/0192035 | A1 | * | 12/2002 | MacDonald | 405/286 |
| 2003/0012609 | A1 | * | 1/2003 | Woolford | 405/286 |

FOREIGN PATENT DOCUMENTS

| | | |
|---|---|---|
| WO | WO2005/113911 | 12/2005 |

* cited by examiner

RETAINING WALL AND BLOCKS FOR THE FORMATION THEREOF

FIELD OF THE INVENTION

The present invention relates to a retaining wall and blocks for use in the formation thereof. While the invention is described with reference to a retaining wall, it will be recognised that the structure described is also suitable for use in mass gravity walls, reinforced soil structures, bridge abutments, stream channels, coastal protection systems, sea walls, erosion prevention, tunnel access, wing walls, storage bins and similar applications.

INTERPRETATION

As used herein, the terms "front face" and "back face" are interpreted according to the orientation of a block in ordinary use, the front face being the face which is visible in use. For example, where the blocks are used to form a retaining wall, the "back face" is the side which is against the earth or other substance being retained and the "front face" is the face visible to passers-by.

BACKGROUND

It is known to use stacked blocks to create retaining walls. These blocks may have a tapered shape, so that they can be fitted together in a curve. One popular product is the MASSBLOC® retaining wall system, which utilises tapered blocks with a facetted front profile.

Some models, such as the KEYSTONE® planter unit, contain cavities, which reduce the weight of each block, and can be filled with soil to hold vegetation, improving the aesthetic qualities of the wall. Blocks of this general type are disclosed in U.S. Pat. Nos. 5,601,384, 6,622,445, 6,701,687, and 4,920,712.

One major problem with existing blocks is that the centre of mass is located towards the front of the block, reducing the stability of the retaining wall. The MASSBLOC® retaining wall system comprises two types of blocks—a base block for the bottom layer of a wall, and a standard block that has a lip protruding from the lower back edge of the block, which fits behind the block below to ensure that the blocks on each layer are the same distance back from the layer below. However, this requires the use of two different types of blocks in constructing the retaining wall, with the accompanying inefficiencies and increased costs.

SUMMARY OF INVENTION

An object of the present invention is the provision of an improved block which is designed so that a single block shape can be used for an entire structure. A further object of the present invention is the provision of a block designed to be exceptionally stable when the block is built into a structure.

A block having at least one front face, at least one back face, sides connecting the front and back faces, a top surface, a bottom surface and at least one cavity passing through the entire height of the block from the top surface to the bottom surface, wherein the cavity is positioned so that the centre of mass of the block lies closer to the back face than does the geometric centre of the block.

Preferably the block is tapered from the front to the back, such that the back is narrower than the front, has a flat bottom surface and a lip on the top surface at the front of the block. Preferably, the block has a single, curved front face and the lip on the top surface at the front of the block also is curved, in a reverse curve to the curve of the front face, so that the lip is oval in plan view.

The block may have vertical grooves in each side panel of the block, near the front, adapted to receive a spacer plate between adjacent blocks. The block may also have a groove across the top of the block, which may be fitted with a rod to secure a geotextile.

In addition, the back face of the block and the sides of the back of the block may be formed with horizontal slots for receiving a structural connecting tie. Preferably, the structural connecting tie is designed to provide a strong connection between the upper and lower course of the wall, and further, to provide a tensile connection.

The present invention also provides a structure made from two or more rows of the above described blocks; the structure may be a retaining wall. The rows of blocks may be straight or curved.

In each row of blocks, adjacent blocks may be in contact with each other or may be spaced apart by a predetermined gap; spacer plates may be fitted into grooves in the sides of adjacent blocks to close off the gaps. Spacer plates are particularly useful when the row is curved, since they allow adjacent blocks to be spaced apart sufficiently to achieve the desired shape of the row without leaving unsightly gaps.

The blocks may be fabricated from a porous substance, such as no fines concrete, and the spacer plates are fabricated from a durable substance such as fibre cement sheeting, concrete, fibre glass, plastic or treated timber.

BRIEF DESCRIPTION OF DRAWINGS

By way of example only, a preferred embodiment of the invention is described below with reference to the accompanying drawings, wherein.

BEST METHOD OF CARRYING OUT THE INVENTION

Figure 1:
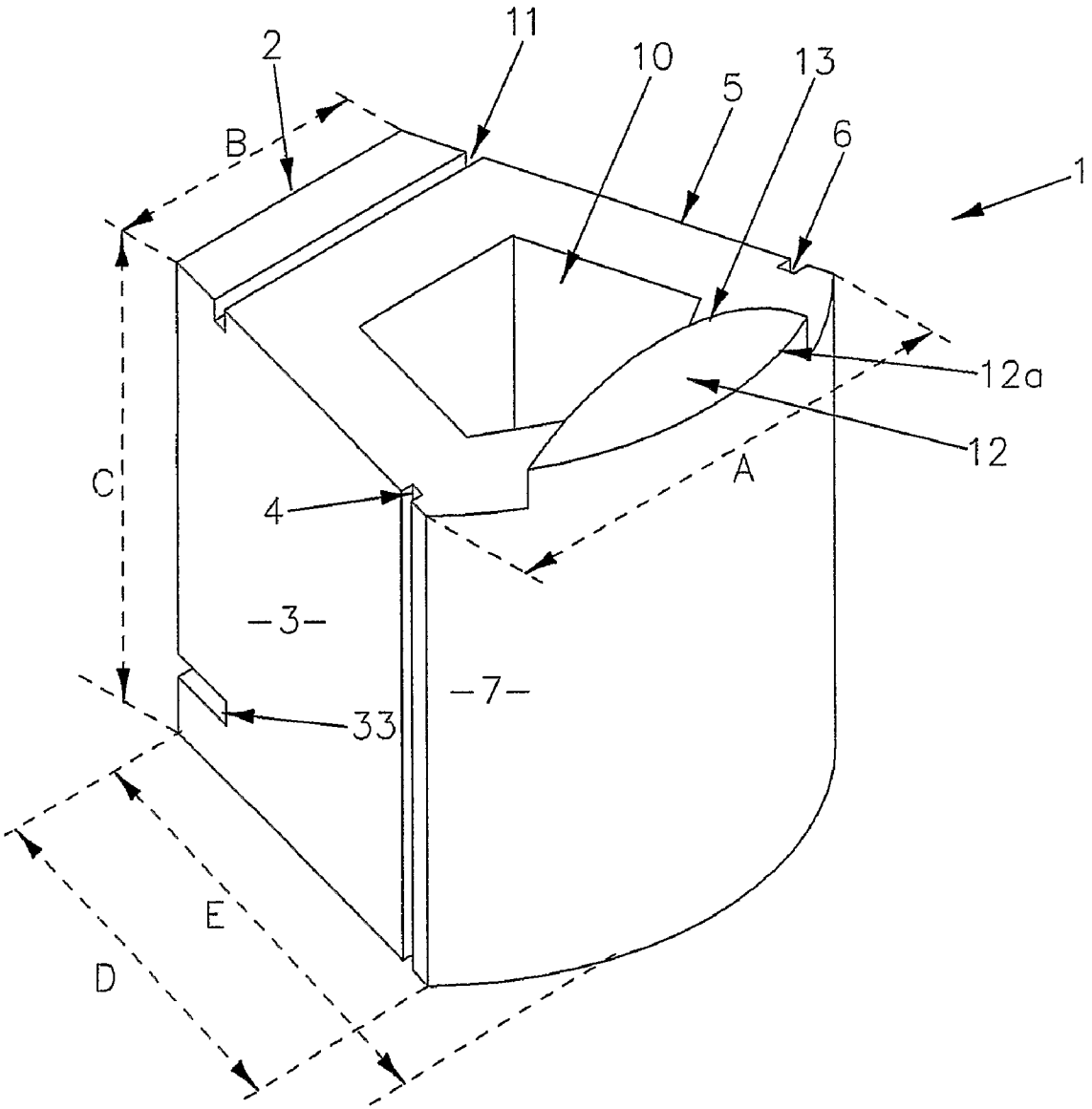
FIG. 1 is a perspective view of a block.

A preferred embodiment of a block according to the present invention is shown in FIG. 1. A block 1 has a horizontal cross-section having a back face 2, a first side face 3 with a first vertical groove 4 and a second side face 5 with a second vertical groove 6 and a curved front face 7, with a cavity 10 passing through the entire height of the block.

The vertical grooves 4,6 are shown as narrow grooves, but may in fact be large cutouts.

Figure 1A:
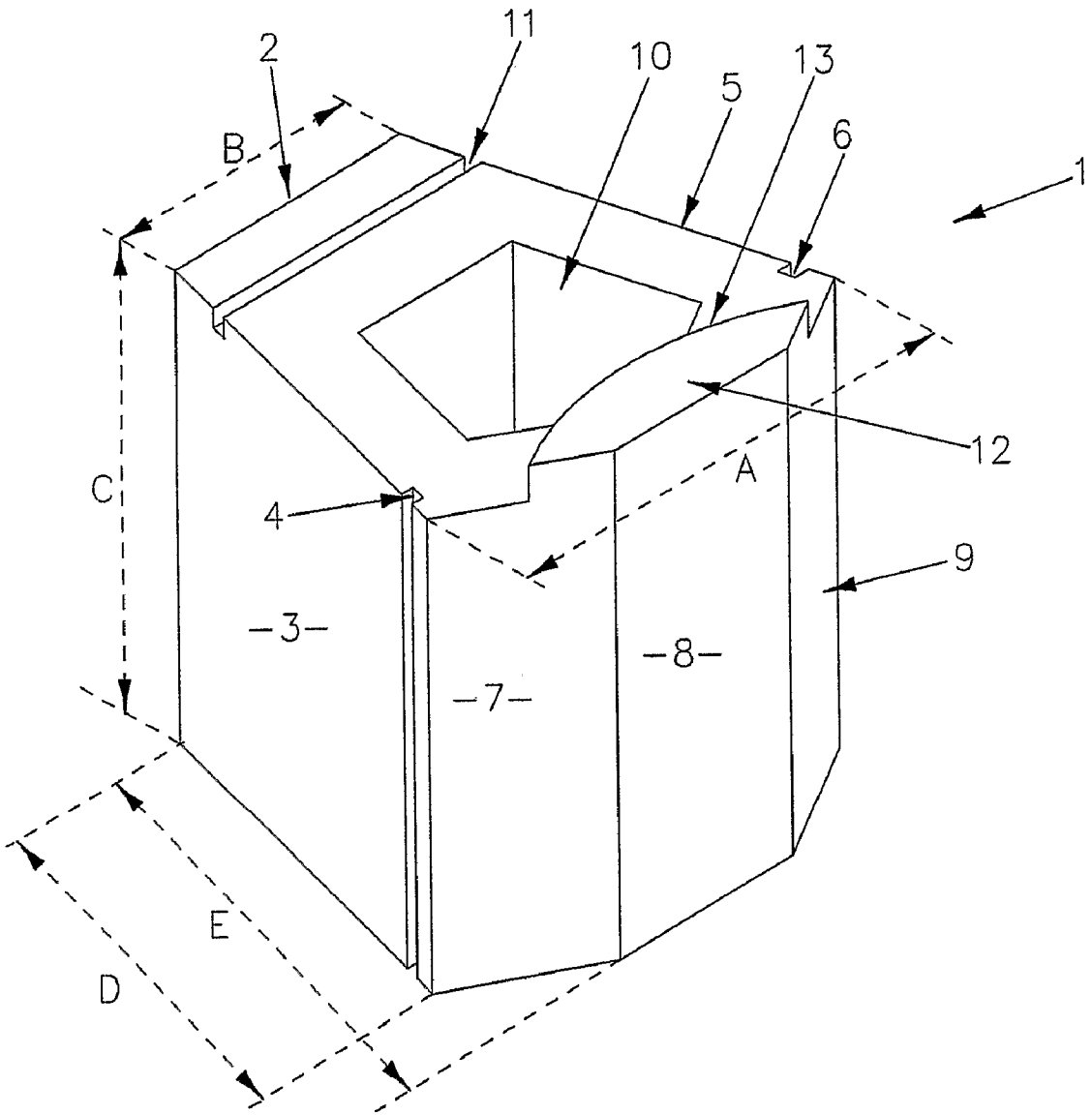
FIG. 1*a* is a perspective view of a block variant of the block of FIG. 1.

The back face 2 has a width B which is significantly less than the overall width A of the front face 7. The front face 7 is depicted in the drawings as a smooth curve with an approximate radius of 800 mm; the radius of the front face may be varied as required by the selected proportions of the block. Alternatively, the front face could be formed as two or more angled flat faces to give a faceted appearance to the block. This variant is shown in FIG. 1*a*, which depicts a block with three angled front faces 7,8 and 9.

The cavity 10 is set towards the front of the block 1 so that the centre of mass of the block 1 lies behind its geometric centre. The distance by which the centre of mass of the block is moved back from the geometric centre obviously depends upon both the dimensions and the proportions of the block; for example, for a block of the general proportions shown in FIG. 1, with a depth of 1041 mm, the positioning of the cavity 10 is such that the centre of mass is moved towards the back of the block relative to the geometric centre by approximately 30 mm. The object of moving the centre of mass towards the rear of the block is to increase the stability of the block when it is built into a structure such as a retaining wall, where the pressure on the blocks falls on the rear faces of the blocks and thus tends to tip the blocks forwards.

The base of the block 1 is substantially planar. A top groove 11 is formed across the top of block 1 adjacent the back face 2 and parallel to the back face. The block 1 may be provided with one or more lifting eyes (not shown) to facilitate lifting the block.

A raised lip 12 is formed on the top of the block, integral with the block. The front edge 12 a of the lip 12 follows the curve of the front face 7 of the block, and the rear edge 13 of the lip 12 is formed with a reverse curve. The lip 12 in use provides a guide for the setback of each row of blocks in a structure, after the first row. It is of course known to provide a protrusion on a block to assist in correct setting of second and subsequent rows of blocks, but the protrusion normally is formed on the underside of the block rather than on the upper surface. Forming the lip on the top of the block means that, in a wall under construction, it is very easy to verify that the second and subsequent rows have been correctly positioned, because the position of each of the second and subsequent rows relative to the lips of the blocks on the underlying row can easily be visually checked.

Curvature to the rear edge 13 of the lip 12 provides further advantages, because it results in a small contact area between the front face of the block 7 and the rear edge 13 of the lip 12. Furthermore, the curved shape of the rear edge 13 reduces the amount of variation in the setback obtained between subsequent rows of blocks when forming curved rows of blocks. It is even more advantageous if both the rear edge 13 of the lip 12 is curved and the front face 7 is also curved, because this further reduces variation in the point of contact between the two surfaces and results in less variation in the setback obtained for the blocks when formed into subsequent layers of curved rows. Furthermore, the junction between the curved front face 12 and the rear edge 13 of the lip allows for a greater versatility in the positioning of the blocks without losing contract between the lip 12 and the next uppermost row of blocks.

The back face 2 of the block is formed with a transverse slot 30 parallel to, and a short distance below, the upper edge of 31 of the back face. L-shaped slots 32,33 are formed with one limb of the L on each side face 3,5 adjacent the back face and the other limb of the L, extending onto the adjacent part of the back face 2. The slots 32,33 are aligned and a short distance above the lower edge 34 of the back face of the block. The slots 30,32,33 used to receive securing ties as described below. However, if the block is to be used only for low rise structures (typically three rows or less) then these slots are not required.

The block 1 may typically have dimensions of greatest width A being 1200 mm, back width B being 650 mm, height C being 1000 mm, depth D being 950 mm and full depth E being 1200 mm.

Figure 2:
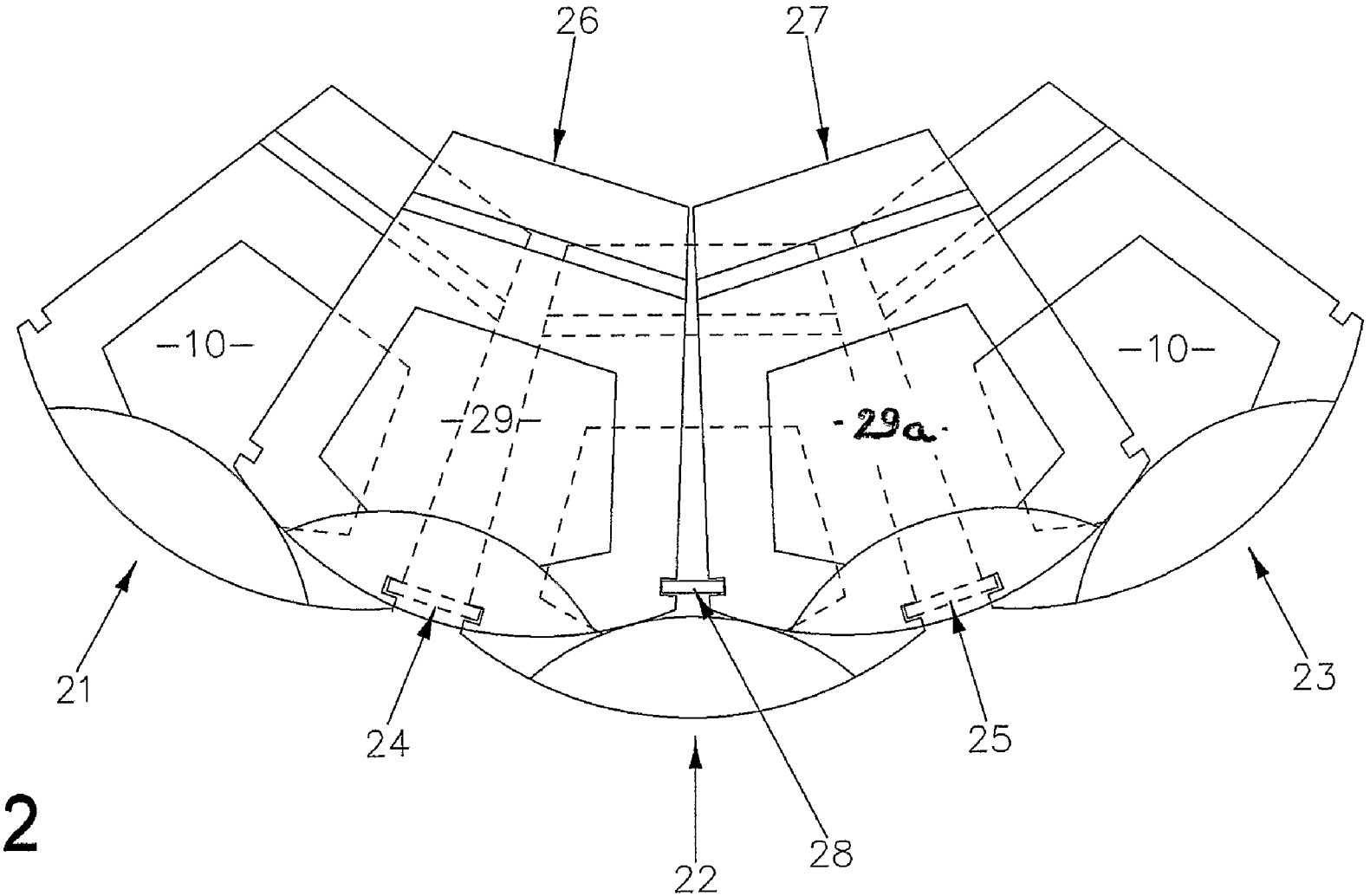
FIG. 2 is a plan view of part of a retaining wall.
Figure 3:
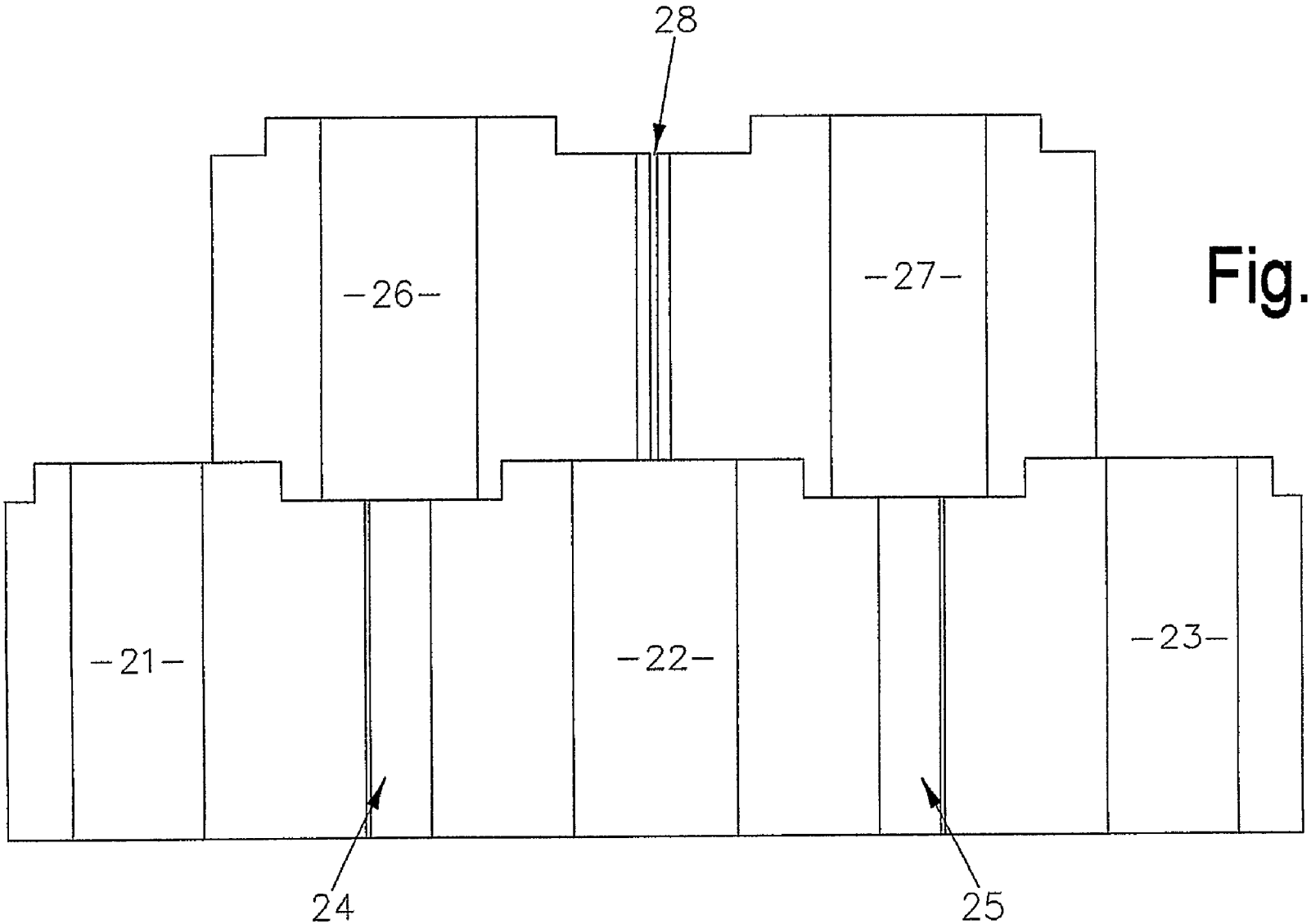
FIG. 3 is a front view of part of a retaining wall.

Blocks 1 are used to form a retaining wall, as shown in FIG. 2 and FIG. 3. The blocks 1 of the present invention can be used to form a wall which is either curved or substantially straight, or with variable curvature. A first layer of blocks 21, 22 and 23 is placed directly on a prepared substrate. In a curved wall, such as that shown in FIG. 2, a spacer plate 24 is fitted into first vertical groove 4 in block 22 and second vertical groove 6 in block 21, to fit the space between the blocks. Likewise, a spacer plate 25 is fitted into first vertical groove 4 in block 23 and second vertical groove 6 in block 22. If greater stability is required, the cavity 10 in each block, and the space 29 between blocks 21 and 22 and spacer plate 24 and the space 29*a* between blocks 22 and 23 and spacer plate 25 can be filled with soil, hard fill or concrete.

A second layer of blocks 26 and 27 is then placed on top of the first layer of blocks 21, 22 and 23 in a running bond pattern, i.e. the blocks 26,27 are offset from the blocks beneath by half a block width. Other patterns such as stack bond may also be used, i.e. one row is placed on top of the other with no lateral offset. The second layer of blocks is placed so that the front face 7 of block 27 and the front face 7 of block 26 is in contact with the curved surface 13 of the lip 12 of block 22 in the first layer. A spacer plate 28 is fitted into the first vertical groove 4 in block 27 and the second vertical groove 6 in block 26 to fit the space between the blocks. This pattern may be repeated for as many layers as desired. The blocks may be locked or bound together horizontally and/or vertically (see below).

To create a straight wall, the blocks 1 are simply positioned in a straight line. In this configuration, spacer plates are not required, but if it is preferred to space the blocks somewhat further apart, then spacer plates may be used to fill the gaps between the blocks.

Figure 5:
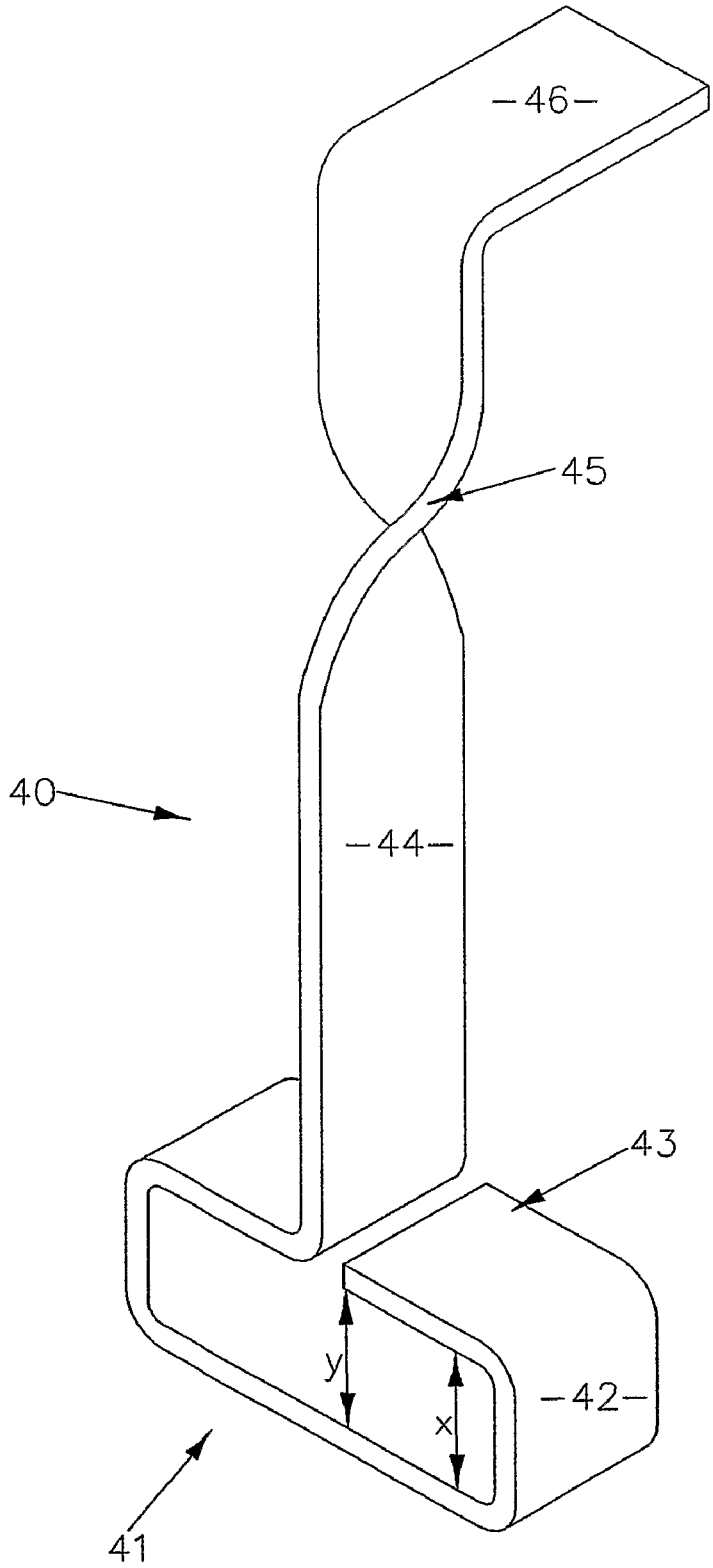
FIG. 5 is an isometric view of a tie.

If a structure to be made from the blocks 1 is more than three rows of blocks high, or if a particularly strong structure is required, a tie as shown in FIG. 5 may be used to provide a strong tensile connection between adjacent rows of blocks.

The tie 40 may be made of any suitable material; it is depicted as made from stainless steel plate. The tie 40 consists of a foot portion 41 which tapers in height along its length, i.e. the outer end 42 has a height X which is less than the height Y of the inner end 43 of the foot. Thus, when the foot portion 41 is driven into the slot 30 in the back of one of the blocks, the shape of the foot portion securely wedges the tie tightly into the slot.

Figure 4:
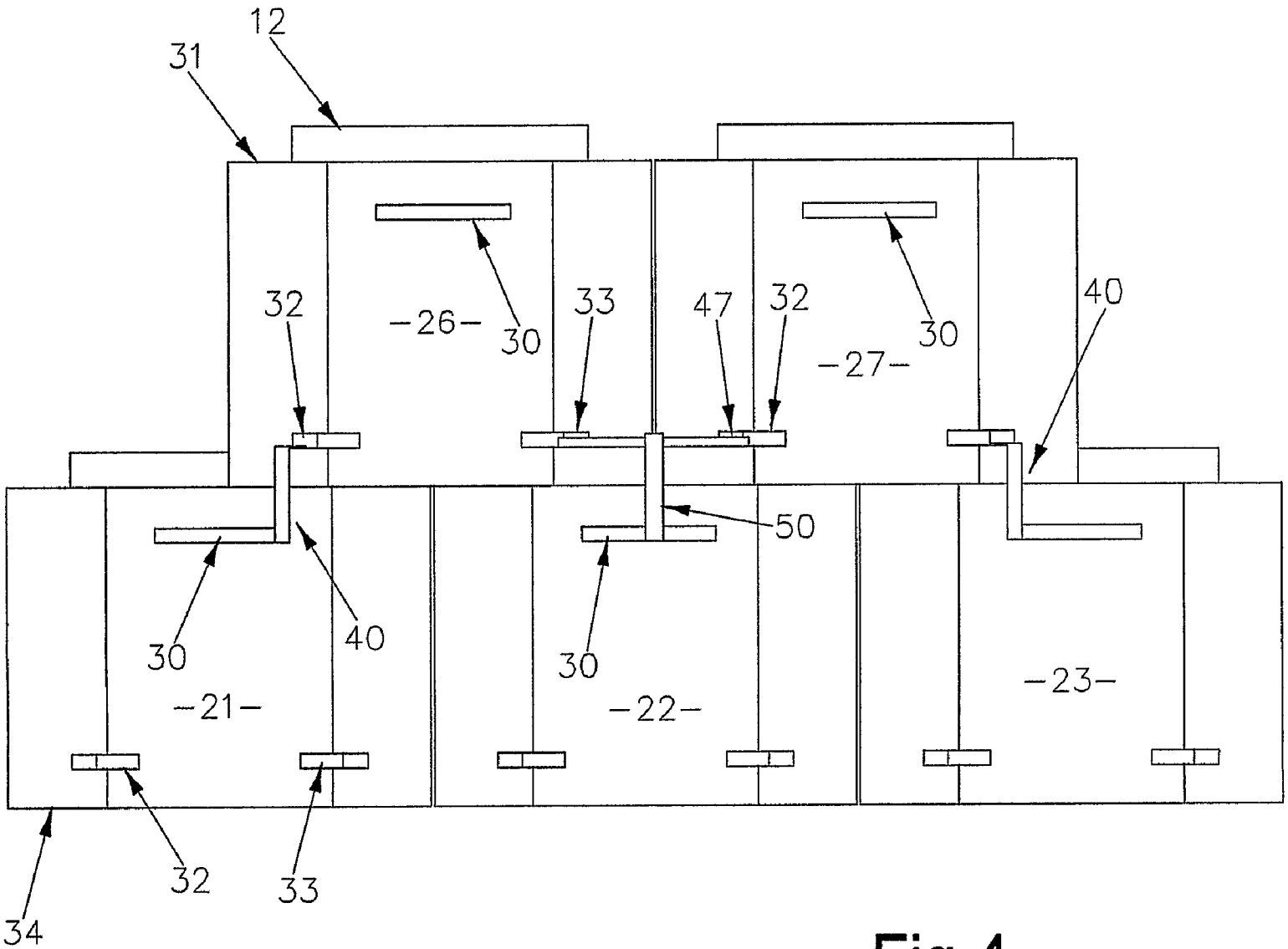
FIG. 4 is a rear view of part of a retaining wall.
Figure 6:
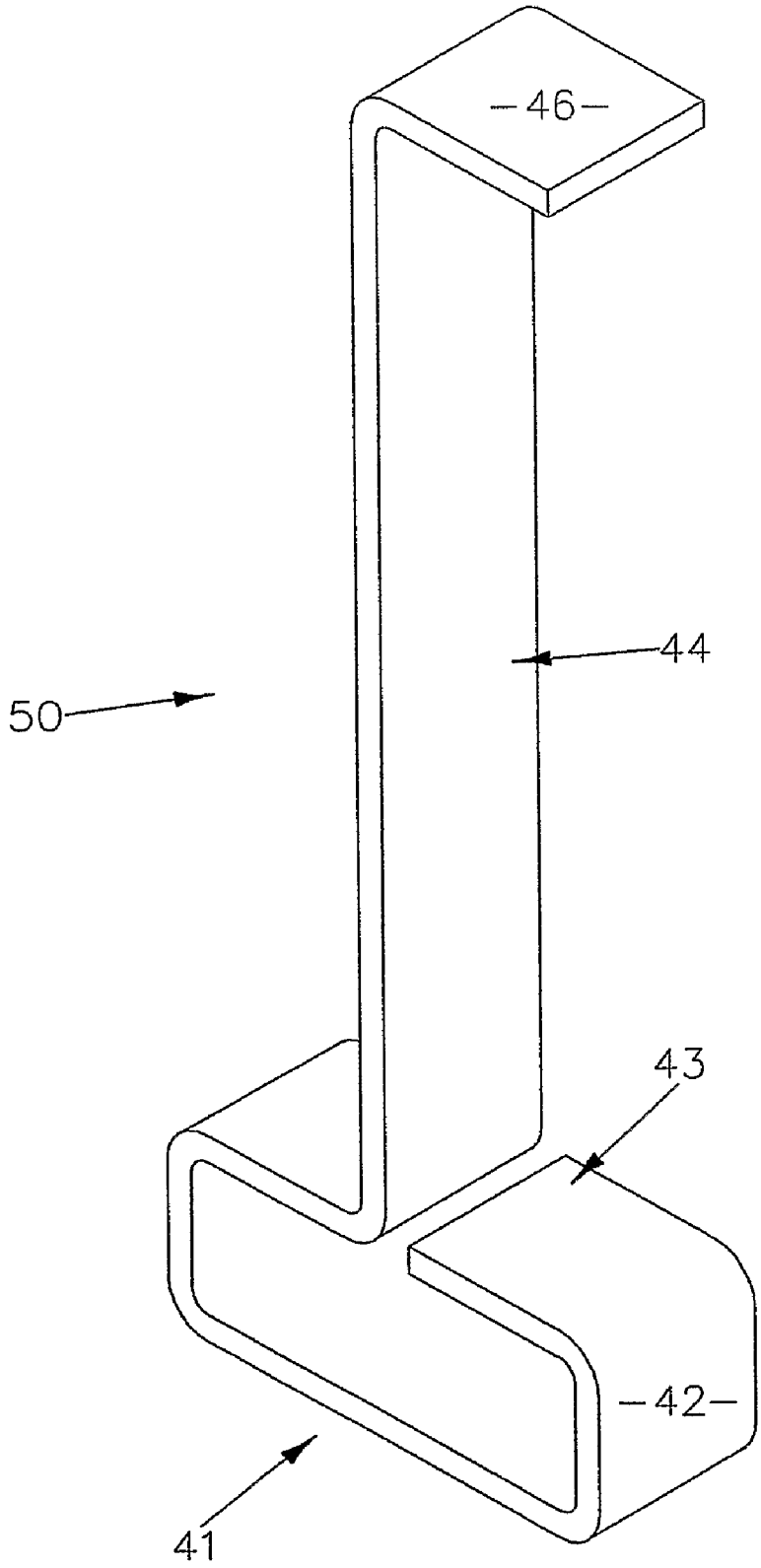
FIG. 6 is an isometric view of a second type of tie.

The shank 44 of the tie is formed with a twist 45 so that the end 46 of the tie, which lies in a plane parallel to the plane of the foot portion 41, extends perpendicular to the foot 41, so that the end 46 can engage in the slot 32/33 of an adjacent block in the row above, as shown in FIG. 4. As shown in that figure, a row of blocks may be secured to the adjacent row of blocks either by using twisted ties as shown in FIG. 5, which engage individually with a corresponding slot 32/33, or by using a straight tie 50 as shown in FIG. 6, which engages with a bar 47 engaged between two opposed slots 32/33. The straight tie 50 is the same as the twisted tie time shown in FIG. 5 except that the twist 45 is omitted from the shank 44, so that the end 46 of the tie is aligned with the foot 41.

The ties 40,50 provide an easily used connection between the blocks which also gives a strong tensile connection. It should be noted that the connection formed between the blocks are the ties 40,50 are designed to allow sufficient movement of the blocks to accommodate the active pressure on a structure such as a retaining wall, from the soil behind the wall:—this active pressure typically applies a lateral and downwards pressure to the back of the wall, causing the wall to rotate forwards.

When they are filled with soil, as described above, cavities 10 may be used as planter boxes. In the top layer, filled cavities 10 may be used to secure traffic protection devices, such as guardrails or barriers, lamp posts, hand rails or signs etc.

A bar (not shown) may be fitted into top groove 11, and a geotextile is fed around the bar in a loop. The geotextile reinforces the soil which is being retained and holds the wall into the soil. This bar in groove fitting provides sufficient strength to achieve close to the full tensile capacity of the geotextile.

The blocks 1 can be fabricated from no-fines concrete (concrete in which the fine sandy material is removed). The use of a porous material allows water to drain through the blocks 1, reducing the pressure applied to the wall. The spacer plates may be fabricated from fibre cement sheeting.

The invention claimed is:

1. A block having at least one front face, at least one back face, sides connecting the front and back faces, a top surface, a bottom surface and at least one cavity passing through the entire height of the block from the top surface to the bottom surface, wherein the cavity is positioned so that the centre of mass of the block lies closer to the back face than does the geometric centre of the block, and wherein the full depth of the top surface is substantially the same as the full depth of the bottom surface; the full depth being defined as the maximum distance between the front and back faces.

2. The block as claimed in claim 1, wherein the block also includes a lip formed on the top surface at or adjacent the front of the block.

3. The block as claimed in claim 2, wherein the edge of the lip furthest from the front of the block is curved.

4. The block as claimed in claim 1, wherein the front face of the block consists of two or more flat faces.

5. The block as claimed in claim 1, wherein the block has a curved front face and also includes a lip formed on the top surface adjacent said curved front face, the edge of the lip furthest from the front of the block being curved in reverse curve to the curve of the front face.

6. The block as claimed in claim 1, wherein the block is formed with vertical grooves down each side near the front of the block, each said groove being configured to receive a spacer plate.

7. The block as claimed in any one of the preceding claims, wherein the block is tapered from the front to the back, such that the back face is narrower than the front of the block.

8. The block as claimed in claim 1, wherein the block has a planar bottom surface.

9. The block as claimed in claim 1, wherein the back face of the block is formed with a transverse slot parallel to the upper edge of the back surface.

10. The block as claimed in claim 9, wherein L-shaped slots are formed, with one limb of the L on each side face adjacent the back face, and the second limb of the L extending onto the adjacent part of the back face.

11. A block as claimed in claim 1, when the block is formed with a groove across the top of the block, said groove being configured to receive a rod for securing a geotextile.

12. The block as claimed in claim 1, wherein the block incorporates means to facilitate lifting the block.

13. The block as claimed in claim 1, wherein the block is fabricated from a porous substance.

14. The block as claimed in claim 13, wherein the block is fabricated from no fines concrete.

15. A tie for use in combination with a block as claimed in claim 10, said tie providing a tapered foot portion configured to be wedged into said transverse slot, and an L-shaped end configured to engage one of said L-shaped slots.

16. A structure made from two or more rows of blocks as claimed in any one of claims 1-6.

17. A structure made from two or more rows of blocks as claimed in claim 10, wherein each row of blocks is secured to the row of blocks immediately above by means of a plurality of ties, wherein each tie provides a tapered foot portion configured to be wedged into said transverse slot, and an end connected to and spaced from said foot by a shank; wherein the foot of each tie is wedged into the transverse slot of a block in a lower row of blocks and the end of each tie is engaged either with one of said L-shaped slots in the immediately adjacent upper row of blocks or with a crossbar engaged between two adjacent L-shaped slots in the immediately adjacent upper row of blocks, so as to form a structural connection between said blocks.

18. A structure as claimed in claim 17, wherein said structure is a retaining wall.

* * * * *